United States Patent [19]

Chance et al.

[11] Patent Number: 4,818,243

[45] Date of Patent: Apr. 4, 1989

[54] WRINKLE RESISTANT FABRIC PRODUCED BY CROSSLINKING CELLULOSIC MATERIALS WITH ACETALS OF GLYCERALDEHYDE

[75] Inventors: Leon H. Chance; Gary F. Danna, both of New Orleans, La.

[73] Assignee: The United States of America as represented by the Secretary of Agriculture, Washington, D.C.

[21] Appl. No.: 50,436

[22] Filed: May 18, 1987

[51] Int. Cl.[4] ..... D06M 13/12
[52] U.S. Cl. ..... 8/116.4
[58] Field of Search ..... 8/116.4

[56] References Cited

U.S. PATENT DOCUMENTS 2,548,455 7/1949 Walker et al. .

OTHER PUBLICATIONS

Frick, J. G., Jr. and R. J. Harper, Jr., J. Applied Polymer Science, 19, 1433–1447 (1984).

Frick, J. G., J. Applied Polymer Science, 30, 3467–3477 (1985).

Witzemann, E. J., et al., Organic Synthesis, vol. II, pp. 307–308 (1943).

*Primary Examiner*—James C. Cannon

*Attorney, Agent, or Firm*—M. Howard Silverstein; Raymond C. Von Bodungen; David G. McConnell

[57] ABSTRACT

Acetals of glyceraldehyde, when applied to cotton fabric by conventional pad-dry-cure procedures using special combined acid catalysts, were found to crosslink the cellulose hydroxyl groups at a very rapid rate (e.g., 10 seconds at 170° C.), thereby imparting improved wrinkle recovery. In particular, the aldehydes studied were the diethyl and dimethyl acetals of glyceraldehyde. The best results were obtained with glyceraldehyde dimethyl acetal.

12 Claims, No Drawings

WRINKLE RESISTANT FABRIC PRODUCED BY CROSSLINKING CELLULOSIC MATERIALS WITH ACETALS OF GLYCERALDEHYDE

BACKGROUND OF THE INVENTION

1. Field of the Invention

This invention relates to wrinkle resistant fabrics.

2. Description of the Prior Art

The use of acetals for crosslinking cellulosic materials to produce improved wrinkle recovery has been reported. Walker (U.S. Pat. No. 2,548,455) reported the crosslinking of paper, starch, regenerated cellulose, and cotton with 2,5-dimethoxytetrahydrofuran. However, his process was not very practical since it required curing for 15 min. at 140° C. Although Walker used 2,5-dimethoxytetrahydrofuran, he in effect obtained crosslinking with the dialdehyde, succinaldehyde, which is the hydrolysis product formed in the reaction with the cellulose.

Frick and Harper [Frick, J. G., Jr., and R. J. Harper, Jr., *J. Applied Polymer Sci.* 29, 1433–1447 (1984) and Frick, J. G., Jr., *J. Applied Polymer Sci.* 30, 3467–3477 (1985)] found that acetals derived from dialdehydes crosslinked cotton to produce improved wrinkle recovery but they also reported that acetals of monoaldehydes were not reactive to produce wrinkle resistance.

SUMMARY OF THE INVENTION

Novel improved wrinkle resistant cellulosic fabric characterized by a glyceraldehyde crosslink of the following structure:

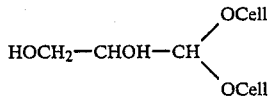

with a cellulose matrix and process for production is disclosed.

The main object of the invention is to provide a process for treating cellulosic materials with dialkoxy acetals of glyceraldehyde in the presence of special combination acid catalysts, thereby crosslinking the cellulose at a very rapid rate to produce a material with an improved wrinkle recovery.

A second object of the invention is to provide a process for treating cotton fabric with glyceraldehyde diethyl acetal or glyceraldehyde dimethyl acetal in the presence of an acid catalyst and an hydroxy acid activator, thereby producing a fabric with improved wrinkle recovery.

A third object of the invention is to provide a conventional pad-dry-cure process for treating cotton fabric with said diacetals in the presence of said catalysts to provide wrinkle resistant fabrics for use in permanent press textiles, said textiles having the advantage of no release of toxic formaldehyde.

DESCRIPTION OF THE PREFERRED EMBODIMENTS

Acetals of glyceraldehyde are found to react with cellulosic materials, which in theory crosslink the hydroxyl groups of the cellulose to give desirable wrinkle resistant properties. Acetals suitable for this invention include acetals of glyceraldehyde such as dimethyl, diethyl, diisopropyl, and di(tert-butyl) although the preferred aldehyde is dl-glyceraldehyde, which is a mixture of the d- and l-isomers. The preferred acetal is dl-glyceraldehyde dimethyl acetal.

The following general equation represents how the reaction of celulose with acetals of glyceraldehyde proceeds:

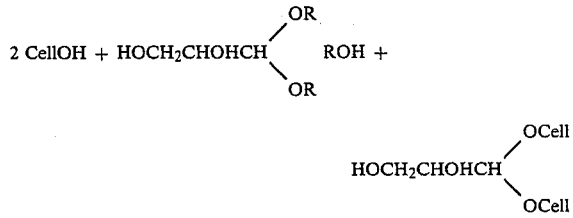

Whereas this invention is primarily concerned with a process for treating cotton fabrics, other cellulosic materials may be used. These include regenerated cellulose, paper, starch, and the cotton in cotton/polyester blends. When the cellulosic material is cotton fabric or a cotton/polyester blend, an improvement in wrinkle recovery and dimensional stability of the fabric is obtained. Such improvement in wrinkle recovery is an indication of cellulose crosslinking. Fibers from fabrics treated with acetals of the preferred embodiment are insoluble in cupriethylenediamine dihydroxide, which is also an indication of crosslinking. Since these crosslinks form an ether linkage with the cellulose they are resistant to hydrolytic conditions encountered in laundering. In the crosslinking reaction the hydroxyl groups of the cellulose react with the alkoxy groups of the acetals and the corresponding alcohol is eliminated in the process.

The acetals used are glyceraldehyde diethyl acetal, hereinafter referred to as GDEA, and glyceraldehyde dimethyl acetal, hereinafter referred to as GDMA. The GDEA and GDMA used in this invention are prepared by the aqueous potassium permanganate oxidation of the appropriate acrolein acetal as described in Organic Synthesis Volume II, pp. 307–308 (1943), the procedure of which is herein incorporated by reference.

Suitable acid catalysts would include metal salts such as aluminum sulfate, aluminum chlorohydroxide, magnesium chloride, zinc nitrate, and certain organic acids such as p-toluene sulfonic acid. The preferred catalyst is aluminum sulfate. A catalyst activator may also be used in combination with any of those mentioned. Activators can be chosen from the group consisting of organic hydroxy acids. The preferred hydroxy acids would be citric acid and tartaric acid or a combination thereof. Although acid catalysts may be used alone it is preferable to use a combination of catalyst and hydroxy acid activator.

Solutions used in treating cellulosic materials are prepared by dissolving acetal and catalyst in water. Concentration of acetal may vary over a range of from about 5% to 20%, and the combined catalyst activator concentration is from about 0.4% to 2.0% on a weight basis, depending on the particular catalyst system selected. In preparing solutions it is advantageous, though not necessary, to use a buffer to help prevent excessive strength loss of fabric due to acid catalyst. An exemplary buffer is a basic aluminum acetate borate of the formula, $Al(OH)_2OAc.\frac{1}{3}H_3BO_3$. It is also advantageous, although not necessary, to add a surface active agent and a softening agent to the solution in order to improve wetting of cellulosic material as well as increase strength and abrasion resistance of material. The pH of the solutions can range from about 2.3 to 6.5 depending on catalyst selected.

Before treating cellulosic material it is important to determine if the material contains any residual alkalinity since this would neutralize a portion of the catalyst and render the catalyst less effective during treatment. If the material is found to be alkaline, it should be soured prior the impregnation step. Souring is conveniently achieved by passing the material through dilute acetic acid and drying. The cellulosic material is impregnated with acetal solution and any excess solution removed, preferably by padding. The material may then be cured without a drying step, or it may be dried prior to curing. It is preferable to dry prior to curing at temperatures ranging from about 70° C. to 90° C. for from about 3 to 5 minutes. After drying, the material is cured at from about 115° C. to 170° C. for from about 10 seconds to 5 minutes, the shortest time at the highest temperature.

The fabric samples treated according to this invention are bleached and scoured 80×80 cotton printcloth, and are tested for conditioned wrinkle recovery angles by the standard method of the American Society for Testing Materials, Philadelphia, Pa., 1964 Book of ASTM Standards, designation D1295-60T, the procedure of which is herein incorporated by reference. After curing, fabric samples were thoroughly rinsed in hot running tap water and oven dried before testing.

The following examples illustrate but are not intended to limit the scope of the invention. All of the fabric samples are soured with 1% acetic acid prior to treatment unless stated otherwise. All of the percentages in the examples are by weight. Wrinkle recovery angles are designated by WRA and the sum of the warp and fill directions (W+F).

EXAMPLE 1

A water solution was prepared containing 10% glyceraldehyde diethyl acetal (GDEA), 0.4% aluminum sulfate of the formula, $Al_2(SO_4)_3.16H_2O$ and 0.4 L(+)-tartaric acid. Samples of cotton printcloth were padded with the solution to a wet pick-up of 70–80% using a laboratory padder. The samples were then dried for 5 minutes in a forced draft oven at 85° C., and cured similarly for 1 minute at 150° C. The fabric was then rinsed in water, oven dried and air equilibrated. It had a weight gain of 3.0% and a wrinkle recovery angle (WRA) of 253° C. (W+F). A similar sample cured for 0.5 minutes at 160° C. had a WRA of 248° C. An untreated control sample had a WRA of 190°.

EXAMPLE 2

A water solution of GDEA was prepared in the same manner as in Example 1 except that it contained 1% of a reactive silicone fabric softener containing silanol end groups. Five cotton printcloth samples were padded with the solution and cured at the following time and temperatures as indicated in Table I. Weight gain (or % add-on) and WRA (warp & fill) are also shown.

| Cure °C./min. | Add-on (%) | WRA(W + F) (degrees) |
|---|---|---|
| 125/2 | 4.3 | 226 |
| 140/0.5 | 5.4 | 232 |
| 115/2 | 3.2 | 222 |
| 115/3 | 4.3 | 231 |
| Untreated Control | | 190 |

The untreated control fabric had a WRA of 190°. All of the samples of Table I show improved results.

EXAMPLE 3

A water solution was prepared containing 10% GDEA, 0.76% $Al_2(SO_4)_3.16H_2O$, 0.77% tartaric acid, 0.28% $Al(OH)_2OAc.\frac{1}{3}H_3BO_3$ as a buffer, 1% silanol softener, and 0.1% of an alkylaryl polyether alcohol [in this case a nonionic wetting agent, Triton X-100 (Rohm and Haas)]. Cotton printcloth samples were treated as in Example 1 and cured as indicated in Table II. Percent weight gain (add-on) and WRA are also shown.

TABLE II

| Cure °C./min. | Add-on (%) | WRA(W + F) (degrees) |
|---|---|---|
| 115/3 | 3.5 | 220 |
| 115/5 | 3.5 | 222 |
| 150/1 | 3.8 | 244 |
| 160/0.5 | 4.2 | 247 |
| 160/1 | 4.4 | 254 |
| 170/0.25 | 3.3 | 251 |
| 170/0.17 | 4.2 | 273 |
| Untreated Control | | 190 |

Samples shown in Table II were dried for 5 minutes at 85° C. When a fabric sample was dried for 2 minutes at 115° C. and cured for 1 minute at 150° C. a WRA of 245° was obtained. All of the treated sample show improvement over the control.

EXAMPLE 4

A water solution was prepared containing 10% GDEA, 0.57% $Al_2(SO_4)_3$, 2.1% L-(+)-tartaric acid, 0.35% $Al(OH)_2OAc.\frac{1}{3}H_3BO_3$, and 1% polyethylene softener instead of the silanol softener used in previous examples. Samples of cotton fabric were padded with the solution, dried 2 minutes at 115° C. and cured as indicated in Table III. Data on % add-on and WRA are also given.

TABLE III

| Cure °C./min. | Add-on (%) | WRA(W + F) (degrees) |
|---|---|---|
| 150/0.5 | 2.2 | 231 |
| 160/0.25 | 1.9 | 224 |
| 160/0.5 | 2.4 | 248 |
| Untreated Control | | 190 |

EXAMPLE 5

A water solution was prepared containing 10% GDEA, 0.77% $Al_2(SO_4)_3$, 0.76% (L-(+)-tartaric acid, 0.28% $Al(OH)_2OAc.\frac{1}{3}H_3BO_3$, and 1% silanol softener. Cotton printcloth samples were padded with the solution, dried 2 minutes at 115° C. and cured as indicated in Table IV. Data on % add-on and WRA are also given. Improvement in all samples over untreated control.

TABLE IV

| Cure °C./min. | Add-on (%) | WRA(W + F) (degrees) |
|---|---|---|
| 150/1 | 2.8 | 245 |
| 160/0.5 | 2.9 | 236 |
| 170/0.25 | 3.3 | 251 |
| Untreated Control | | 190 |

EXAMPLE 6

A water solution was prepared containing 10% GDEA, 0.77% $Al_2(SO_4)_3 \cdot 16H_2O$, 0.37% L-(+)-tartaric acid, 0.35% citric acid, and 0.28% $Al(OH)_2OAc \cdot \frac{1}{3}H_3BO_3$. No softener was used in this formulation. This formulation differs from the preceding examples in that the catalyst activator is a combination of tartaric and citric acids. The samples were dried for 2 minutes at 115° C. Data on treated cotton printcloth samples are shown in Table V clearly indicating improvement over untreated control.

TABLE V

| Cure °C./min. | Add-on (%) | WRA(W + F) (degrees) |
|---|---|---|
| 140/2 | 2.5 | 236 |
| 150/1 | 2.5 | 226 |
| 160/0.5 | 2.1 | 225 |
| Untreated control | | 190 |

EXAMPLE 7

In this example and the following ones dl-glyceraldehyde dimethyl acetal (GDMA) was used instead of glyceraldehyde diethyl acetal. A water solution was prepared containing 10% GDMA, 0.77% $Al_2(SO_4)_3 \cdot 16H_2O$, 0.76% L-(+)-tartaric acid, 0.28% $Al(OH)_2OAc \cdot \frac{1}{3}H_3BO_3$, 1% silanol softener, and 0.1% Triton X-100 wetting agent. Cotton printcloth samples were padded with the solution to a wet pick-up of about 90%, dried for 5 minutes at 85° C. and cured as indicated in Table VI clearly indicating improved values over untreated control. Data on % add-on and WRA are also given.

TABLE VI

| Cure °C./min. | Add-on (%) | WRA(W + F) (degrees) |
|---|---|---|
| 140/2 | 2.9 | 265 |
| 150/1 | 3.7 | 271 |
| 160/0.5 | 3.8 | 270 |
| 170/0.17 | 2.7 | 241 |
| Untreated control | | 190 |

The WRA of the untreated control fabric was 190°. From the WRA values obtained with GDMA it is evident that GDMA is more reactive than GDEA, and therefore preferred. WRA values of 270° are within the range of those required for durable press finishes.

EXAMPLE 8

Example 7 was repeated except that the fabric was not soured with 1% acetic acid prior to treatment. The results are shown in Table VII.

TABLE VII

| Cure °C./min. | Add-on (%) | WRA(W + F) (degrees) |
|---|---|---|
| 140/2 | 3.2 | 247 |
| 150/1 | 3.3 | 260 |
| 160/0.5 | 3.3 | 248 |
| Untreated control | | 190 |

From the WRA values it is obvious that better results were obtained when the fabric was given an acid sour prior to treatment.

EXAMPLE 9

A water solution was prepared containing 10% GDMA, 1% $Al_2(OH)_5Cl.2H_2O$, 1% citric acid, and 1% polyethylene softener. A sample of cotton fabric composed of 50% cotton and 50% polyester was padded with the solution to a wet pick-up of about 65%. The fabric samples were dried for 5 minutes at 85° C. and cured as indicated in Table VIII.

TABLE VIII

| Cure °C./min | Add-on (%) | WRA(W + F) (degrees) | Fabric Color |
|---|---|---|---|
| 200/0.17 | 2.5 | 299 | slightly yellow |
| 190/0.17 | 2.6 | 288 | white |
| 190/0.25 | 2.9 | 296 | slightly yellow |

The WRA of an untreated sample of cotton/polyester (50/50 blend) was 257°. From the table it can be seen that there was a significant improvement in WRA at high temperatures for very short periods of time. A curing temperature of 190° C. for about 10 seconds is preferred since a higher temperature or a longer cure time yellowed the fabric slightly.

We claim:

1. An improved wrinkle resistant cellulosic fabric characterized by a glyceraldehyde crosslink of the following structure

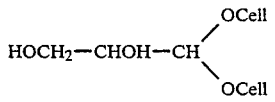

with a cellulose matrix.

2. A process for producing wrinkle resistant cellulosic materials comprising: impregnating cellulose with aqueous solutions of dialkoxy acetals of glyceraldehyde in the presence of an acid catalyst and curing at sufficient time and temperature to produce a glyceraldehyde crosslink with a cellulose matrix.

3. The process of claim 2 wherein the glyceraldehyde crosslink is of the following structure:

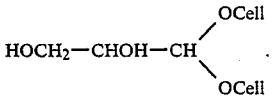

4. The process of claim 2 wherein the aqueous solution of dialkoxy acetals of glyceraldehyde in the presence of acid is in the pH range of from about 2.5 to 6.5.

5. The process of claim 2 wherein the treated cellulose is dried and cured at a temperature of from about 115° to 200° C., for from about 10 seconds to 5 minutes, the higher temperature at the shorter time.

6. The process of claim 2 wherein the acid catalyst is selected from the group consisting of aluminum sulfate, aluminum chlorohydroxide, magnesium chloride and zinc nitrate.

7. The process of claim 2 wherein the solution includes an hydroxy acid catalyst activator selected from the group consisting of citric acid, tartaric acid, and a combination of citric and tartaric acids.

8. The process of claim 2 including an effective buffer in the solution, said buffer effective for preventing cellulose degredation by acid catalyst.

9. The process of claim 8 wherein the buffer is basic aluminum acetate borate.

10. The process of claim 8 wherein the acid catalyst is aluminum sulfate.

11. The process of claim 10 wherein the acetal is dl-glyceraldehyde dimethyl acetal.

12. The process of claim 10 wherein the acetal is dl-glyceraldehyde diethyl acetal.

* * * * *